US007048118B2

(12) United States Patent
Baechle

(10) Patent No.: US 7,048,118 B2
(45) Date of Patent: May 23, 2006

(54) SUPPORT POST WITH LOCKING FEATURE

(75) Inventor: James Baechle, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 130 days.

(21) Appl. No.: 10/605,845

(22) Filed: Oct. 30, 2003

(65) Prior Publication Data

US 2005/0092633 A1 May 5, 2005

(51) Int. Cl.
*B65D 81/107* (2006.01)
*B65D 85/30* (2006.01)

(52) U.S. Cl. ..... 206/320; 206/453; 206/586

(58) Field of Classification Search ..... 206/320, 206/236, 391, 453, 586, 587, 594, 597, 599; 108/55.5

See application file for complete search history.

(56) References Cited

U.S. PATENT DOCUMENTS 3,891,086 A * 6/1975 Isaacs ..... 206/320
3,982,682 A 9/1976 Fremion
4,482,054 A 11/1984 Gardner
4,484,444 A 11/1984 Bidwell
RE32,344 E * 2/1987 Wind ..... 206/599
4,838,176 A * 6/1989 Bowser et al. ..... 108/53.3
5,131,541 A 7/1992 Liebel
5,143,283 A 9/1992 Lancaster
5,154,297 A * 10/1992 Farley ..... 206/599
5,161,692 A 11/1992 Knierim
5,181,611 A 1/1993 Liebel
5,267,651 A 12/1993 Hughes
5,277,310 A * 1/1994 Mertz ..... 206/320
5,307,928 A * 5/1994 Bishop ..... 206/320
5,593,039 A 1/1997 Ortlieb
6,070,535 A * 6/2000 Johnson ..... 108/55.5
6,186,329 B1 * 2/2001 Qiu ..... 306/586
6,357,587 B1 * 3/2002 Melms, Jr. ..... 206/326
6,386,118 B1 * 5/2002 Bendit et al. ..... 108/57.25
6,513,662 B1 * 2/2003 Stebelton ..... 206/586
D472,333 S 3/2003 Shaw

* cited by examiner

*Primary Examiner*—David T. Fidei
(74) *Attorney, Agent, or Firm*—Clausen Miller, P.C.

(57) ABSTRACT

An improved open-sided package assembly 10 for protecting and cushioning a product 12 such as a large appliance, the assembly 10 comprising a molded EPS base 14 and top cap 20 and four support posts 16, 18 extending from the base 14 to the top cap 20. The support posts 16, 18 are shaped in such a way that when they are inserted into the base 14 or top cap 20 they do not fall out.

18 Claims, 4 Drawing Sheets

SUPPORT POST WITH LOCKING FEATURE

BACKGROUND OF INVENTION

This patent relates to protective packaging for large products such as household appliances. More particularly, this patent relates to a packaging system that includes laminated paper support posts that interlock with an EPS base or top cap.

The usual practice in the appliance manufacturing industry has been to fasten the bottom of the appliance to a wooden pallet or other type of base during manufacture. The base is dimensioned to be oversized relative to the appliance's width and depth so that the perimeter of the base extends beyond the appliance perimeter. After the appliance has been completely assembled (and while it is mounted on the base) a rigid but collapsible four-sided corrugated box or sleeve having open top and bottom ends is placed over the appliance and secured to the base. Before a top cap is placed over the box, support posts (a.k.a. corner posts) are inserted at each corner of the appliance between the appliance and the corrugated sleeve so that the posts extend from the base up to the top cap. The corner posts fit snugly against the vertical corners of the packaged appliance to cushion and protect it. The result is a packaged appliance that is protected from impacts, but cannot be viewed without removing the corrugated box.

A trend in the appliance industry has been to package appliances in open-sided (see-through) packages. Open-sided packages do not incorporate a four-sided corrugated box or sleeve. Instead, the open-sided package is wrapped in clear plastic film.

A typical open-sided package for appliances consists of a molded expanded polystyrene (EPS) base and top cap and molded EPS corner protectors that interlock into the base and top cap. An advantage of EPS packages is their interlocking capability. A disadvantage of EPS packages is that stacking strength is achieved by stacking through the appliance since the EPS corner protectors provide minimal, if any, stacking strength.

Sonoco Products Company, the assignee of the present invention, has developed a primarily paper-based open-sided package having high-strength load bearing corner posts. The primarily paper-based package comprises a base on which the appliance is secured, a top cap, and wound paper corner posts. Because the corner posts do not interlock with the base, the base is placed within a paper bottom tray which helps hold the corner posts against the corners of the appliance. Unlike the molded EPS package, stacking strength is provided by the corner posts, not by the appliance. Additional posts may be used as horizontal braces to provide added strength protection for clamp lifting.

The paper-based open-sided package can withstand substantial stacking, clamping and lifting forces. However, in some applications, such as in the packaging of dishwashers, the bottom tray may be exposed to wet conditions, making it desirable to use a water-resistant tray.

Thus it is an object of the present invention to provide an open-sided package for a large appliance that eliminates the paper bottom tray by providing a paper corner post that interlocks with a molded EPS base and/or top cap.

A further object of the present invention is to provide an open-sided package in which the corner posts, not the appliance, bear the stacking load.

Another object of the present invention is to provide an open-sided package for a large appliance that can withstand substantial stacking, clamping and lifting forces.

Further and additional objects will appear from the description, accompanying drawings, and appended claims.

SUMMARY OF INVENTION

The present invention is an improved open-sided packaging assembly for protecting and cushioning a product such as a large appliance. The assembly comprises a water-resistant molded EPS base, a top cap, and four paper corner posts extending from the base to the top cap. The corner posts are shaped in such a way that when they are inserted into the base or top cap they do not fall out. More specifically, the corner posts have locking portions at their bottom and top ends that enable them to interlock with the molded EPS base and top cap.

In one particular embodiment the invention comprises four longitudinal support posts, each having a bottom end and two integrally formed locking tabs disposed at the bottom end, and a rectangular base having openings disposed therein at each corner, the openings being configured to receive the bottom ends of the support posts in interlocking fashion. The support posts are formed from a sheet of paper wound into a tubular structure comprising an outer wall and an inner, product-facing wall substantially coextensive with the outer wall and joined to the outer wall at outer ends to define a hollow space therebetween. The two locking tabs are located at the outer ends of the post. Each of the locking tabs is substantially planar and is formed from adjacent portions of the outer wall and the inner wall.

In a key feature of the invention, the two locking tabs are oriented on non-parallel planes so as to prevent the post from moving in any lateral direction during use. The locking tabs are spaced inwardly from the outer perimeter of the base so that portions of the base abut each outer wall member to help hold the posts in place.

In a second embodiment, each of the paper corner posts has a polygonal locking portion disposed at the bottom end for interlocking with the molded EPS base. The polygonal locking portion preferably is a hollow tubular subsection of the post. For added stability, the corner posts may also have a substantially planar locking tab located at one outer end.

DETAILED DESCRIPTION

Figure 1:
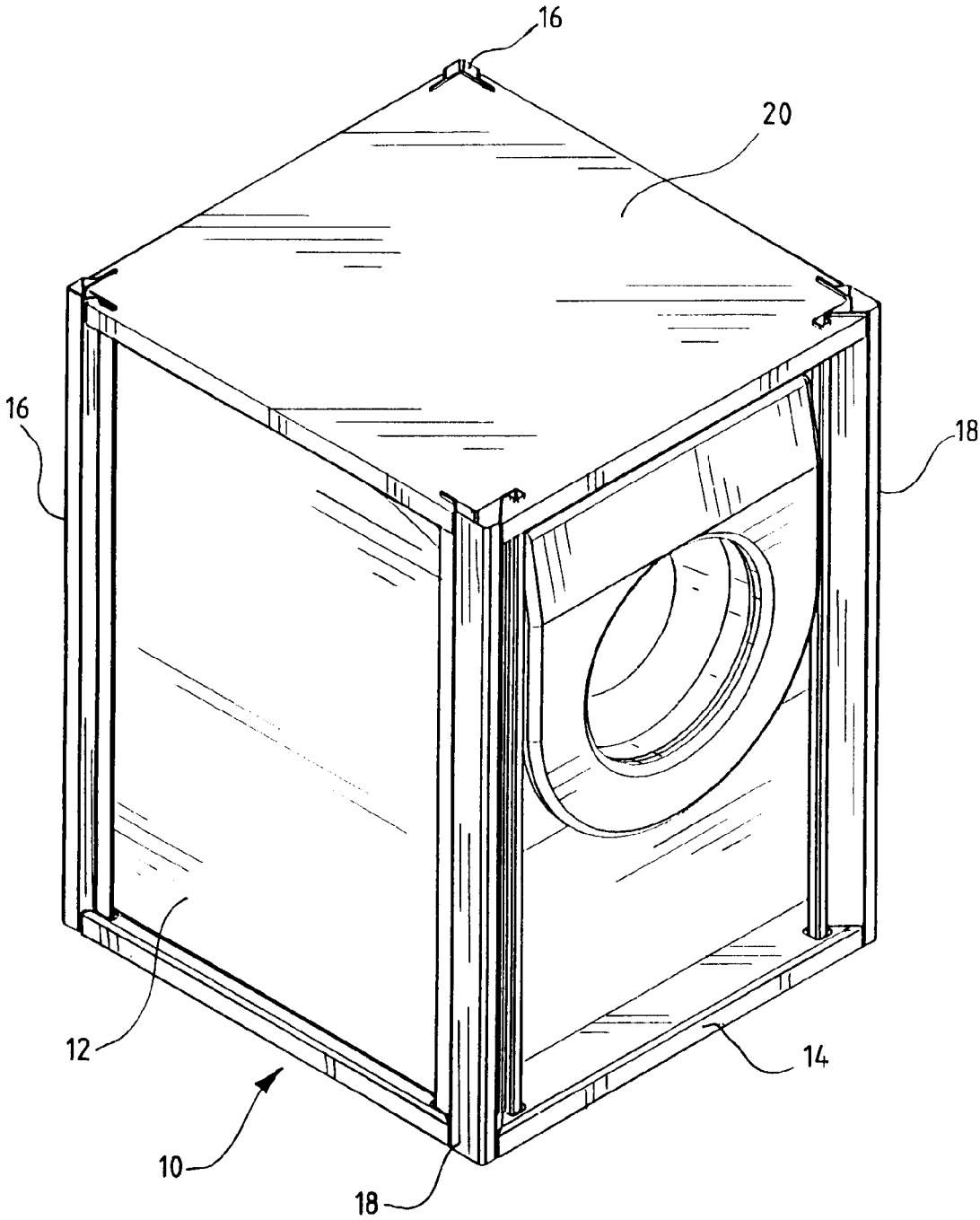
FIG. 1 is a perspective view of an open-sided packaging assembly according to the present invention, including the molded EPS shipping base and the rear and front corner posts.
Figure 2:
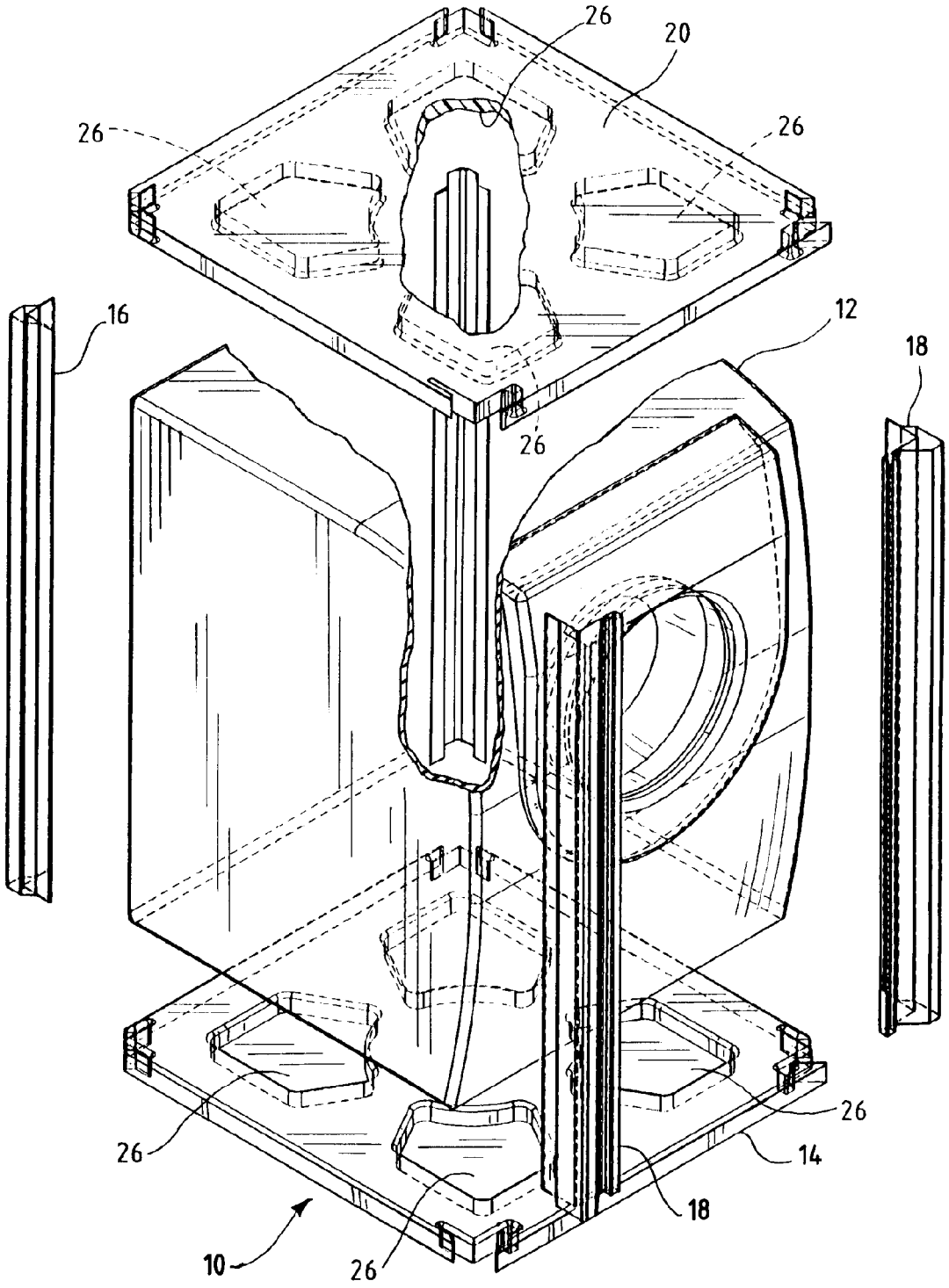
FIG. 2 is an exploded view of the packaging assembly of FIG. 1.

Turning to the drawings, there is shown in FIGS. 1 and 2 a preferred embodiment of the present invention, a packaging assembly 10 for protecting and cushioning a product such as a large appliance 12. The packaging assembly 10 comprises a base 14, two rear corner posts 16 and two front corner posts 18 affixed to the base 14, and a top cap 20. Optional transparent film (not shown) may be wrapped around the package 10 or draped over the product 12 to protect the product 12 from dust and dirt.

Figure 3:
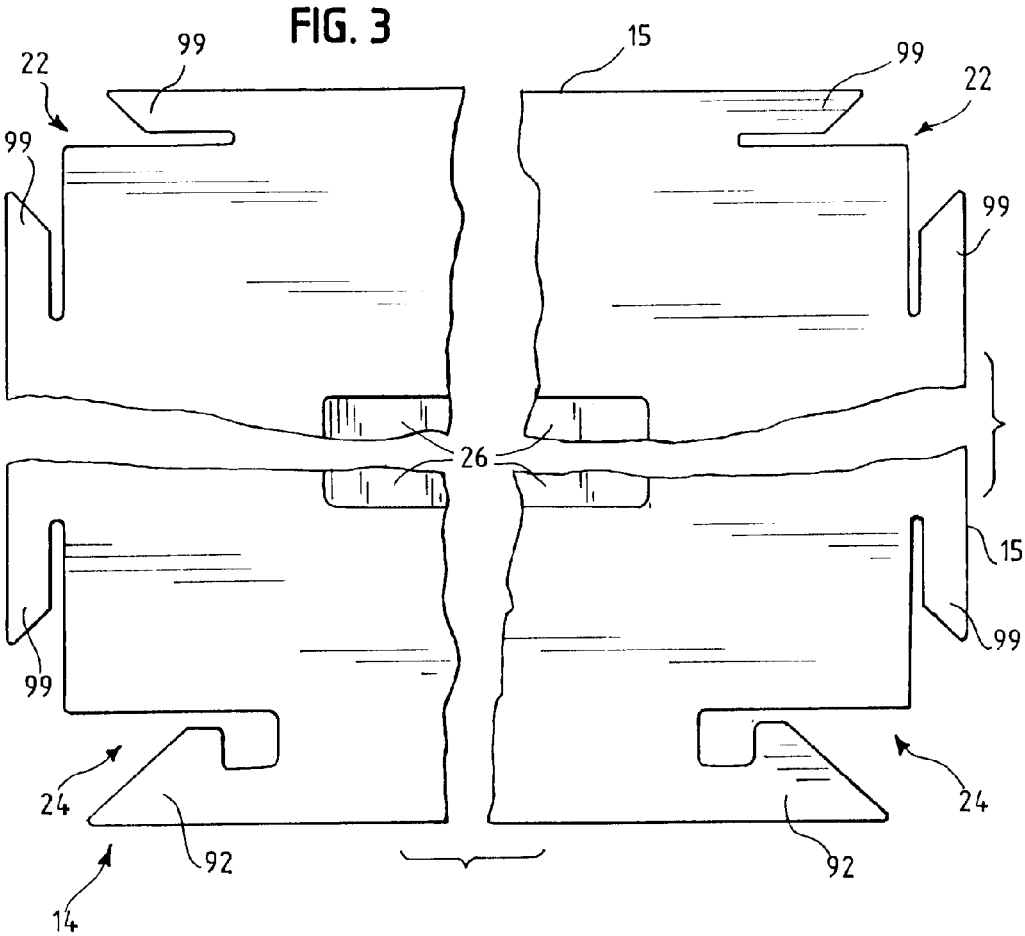
FIG. 3 is a top plan view of the shipping base of FIG. 1.

As best shown in FIG. 3, the base 14 is substantially rectangular and symmetrical about a front to rear central axis. The base 14 has portions for supporting the product and may have additional openings (not shown) for accommodating product feet. Openings 22, 24 at the rear and front corners have the same shape at the cross-sectional shape of the bottom ends of the rear and front corner posts 16, 18 in order to receive the corner posts 16, 18 in interlocking fashion. Preferably the base 14 is formed of water-resistant molded expanded polystyrene (EPS) and may have large depressions 26 disposed in the base 14 to lessen the amount of material required to make the base 14. The base 4 has an outer perimeter 15 somewhat larger than the perimeter of the product so that corner posts that interlock with the base 14 at the corners of the base 14 fit around the product 12 exterior.

Figure 4:
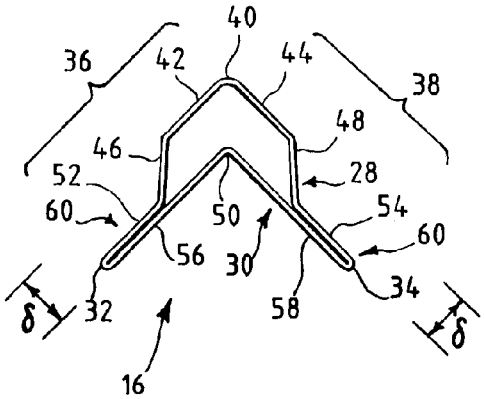
FIG. 4 is a top plan view of one of the rear corner posts of FIG. 1.
Figure 5:
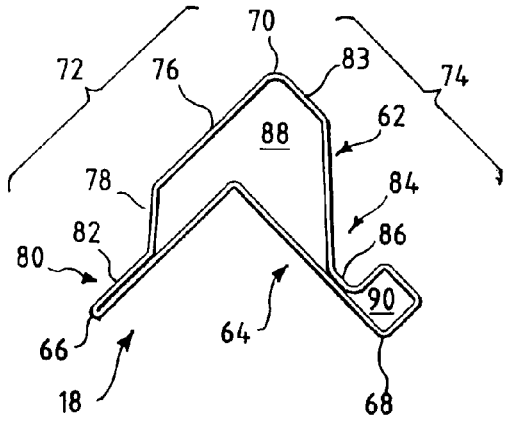
FIG. 5 is a top plan view of one of the front corner posts of FIG. 1.

FIGS. 4 and 5 are top plan views of the rear and front corner posts of FIG. 1, respectively. Directing the reader's attention to FIG. 4, the rear corner posts 16 comprise an outer wall 28 made up of members 36, 38 and a substantially L-shaped inner, product-facing inner wall 30 substantially coextensive with the outer wall 28 and joined to the outer wall 28 at ends 32, 34 to define a hollow space therebetween. The two mirror-image outer wall members 36, 38 are joined at a right angle along an outer edge 40 and extend from the outer edge 40 to the outer ends 32, 34. Beginning at the outer edge 40, the outer wall members 36, 38 comprise first, proximate sections 42, 44 extending at right angles from the outer edge 40, second, intermediate sections 46, 48 extending angularly inward (in the direction of the product) from the first sections 42, 44 toward engagement with the inner wall 30, and third, distal sections 52, 54 extending from the second sections 46, 48 to the ends 32, 34. The first sections 42, 44 define the outer perimeter of the corner post 16 (and package assembly 10) and thus make contact with the transparent film wrapping if it is used. The third sections 52, 54 are substantially parallel to the first sections 42, 44 in the preferred embodiment and are in close proximity or adjacent to the inner wall 30.

Still referring to FIG. 4, the rear corner post inner wall 30 comprises two planar inner wall members 56, 58 joined at a right angle along an inner corner 50 adjacent the product. Each inner wall member 56, 58 extends from the inner corner 50 to one of the outer ends 32, 34.

The distal sections of the inner wall members 56, 58 adjacent the distal sections 52, 54 of the outer wall 28 form locking tabs 60. As explained further below, the locking tabs 60 fit within the rear openings 22 in the base 14. In a key aspect of the invention, the locking tabs 60 are substantially planar but are oriented on non-parallel planes, so together they prevent the corner post from moving in any lateral (horizontal) direction, thereby locking the rear corner posts 16 in place.

Figure 6:
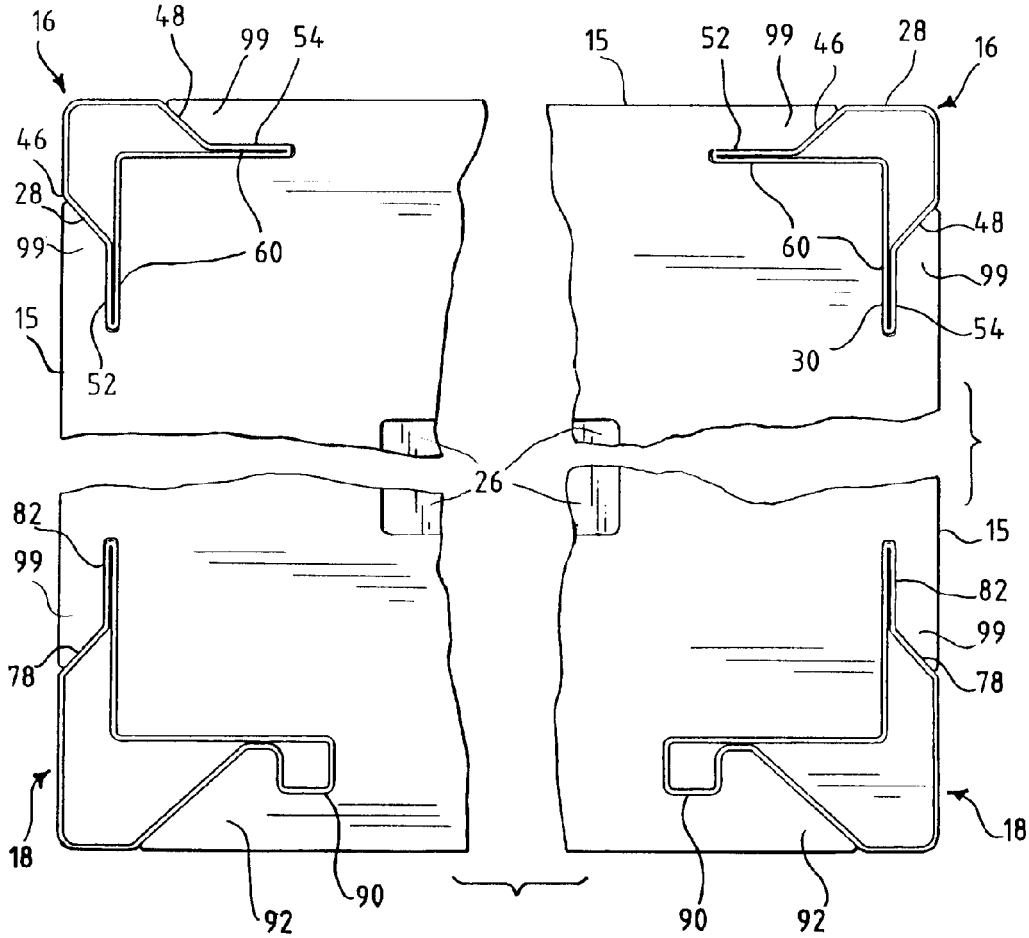
FIG. 6 is a top plan view of the corner posts and shipping base of FIG. 1.

In another key aspect of the invention, the locking tabs 60 are spaced inwardly from the corner post outer perimeter a distance 6 (delta). Consequently, as best shown in FIG. 6, tongue portions 99 of the base 14 abut the outer wall 28 of the rear corner posts 16 to help hold the corner post 16 in place. Specifically, the base 14 abuts the second portions 46, 48 and third portions 52, 54 of the rear post outer wall members 28. The distance 6 should be large enough so that the portion 99 of the base interposed between the corner post 16 and the perimeter 15 of the base 14 is wide enough to prevent breaking during use.

FIG. 5 is a top plan view of a second embodiment of a corner post according to the present invention, one that in the illustrations is used for the front corner posts 18. Each front corner post 18 has a hollow, tubular locking portion 90 as described more fully below and, for added stability, a substantially flat locking tab 80 similar in shape and function to the rear corner post locking tabs 60.

Like the rear corner posts 16, each front corner post 18 comprises an outer wall 62 made up of members 72, 74 and a substantially L-shaped inner, product-facing wall 64 substantially coextensive with the outer wall 62 and joined to the outer wall 62 at ends 66, 68 to define at least one hollow space therebetween. The outer wall first and second members 72, 74 are joined at a right angle along an outer edge 70 and extend from the outer edge 70 to the outer ends 66, 68.

The outer wall first member 72 is similar in shape to the rear corner post outer wall members 36, 38. Beginning at the outer edge 70, the outer wall first member 72 comprises a first, proximate section 76 extending from the outer edge 70, a second, intermediate section 78 extending angularly inward from the first section 76 toward engagement with the inner wall 64, and a third, distal section 82 extending from the second section 78 to the first end 66. The third section 82 is substantially parallel to the first section 76 and together they define a locking tab 80 similar in shape and function to the rear corner post locking tabs 60.

The outer wall second member 74 extends in a nonplanar fashion from the outer edge 70 to an end 68 where it meets the inner wall 64. A first planar section 83 extends from the outer edge 70 at a right angle to the outer wall first member first section 76 to define the outer perimeter of the front corner post 18. The outer wall second member 74 is provided with an inwardly directed bead 84 having an apex 86 in close proximity with or adjacent the inner wall 64. The bead 84 divides the corner post 18 into two longitudinal, tubular, hollow subsections 88, 90. The smaller hollow subsection 90 may be either fully or partially enclosed and functions as a locking portion to further lock the corner post 18 into the base 14. As explained further below, the front corner post locking tab 80 and locking portion 90 fit within the front openings 24 in the base 14 to hold the front corner posts 18 in place.

The front corner post locking tab 80 is spaced inwardly from the corner post outer perimeter so that, as best shown in FIG. 6, tongue portions 99 of the base 14 abut the outer wall 62 of the front corner posts 18. Specifically, the base 14 abuts the second portion 78 and third portion 82 of the front corner post outer wall member 72. The locking tab 80 should be spaced far enough inward from the outer perimeter so that the portion 99 of the base 14 interposed between the corner post 18 and the perimeter 15 of the base 14 is wide enough to prevent breaking during use.

Likewise, the hollow subsection 90 that functions as a locking portion should be spaced far enough inward from the corner post outer perimeter so that the portion 92 of the base 14 interposed between the corner post 18 and the base perimeter 15 is wide enough to prevent breaking during use.

Since the locking portion 90 is polygonal, i.e., it abuts the base 14 on at least three sides (as opposed to two sides for the locking tabs 80), it can by itself prevent the corner post 18 from moving laterally and thus the additional locking tab 80 is not necessary. However, the locking tab 80 increases the stability of the package assembly by providing additional interlocking capability. The locking portions 90 may also be more suitable than the locking tabs 80 on the sides where the appliance has protrusions.

FIG. 6 is a top plan view showing the rear and front corner posts 16, 18 interlocked with the shipping base 14. A dashed line indicates the outer dimensions of the product 12, which is not shown. The corner post locking tabs 60, 80 and the front corner post locking portions 90 fit within the openings 22, 24 (FIG. 3) in the base 14 to lock the corner posts 16, 18 in position without the aid of a bottom tray as in previous open-sided paper-based packaging designs. The locking features (i.e. the locking tabs 60, 80 and the hollow locking portion 90) are spaced inwardly (offset) from the outer perimeter of the corner posts 14, 16 in order that a portion of the base 14 may fit around the outside of the locking features away from the product 12.

The packaging system 10 may also include a top cap 20 that covers the top of the product 20. For simplicity, the top cap 20 may have the same configuration as the base 12 so that the upper ends of the corner posts 16, 18 can be inserted into openings in the top cap 20, as shown in FIG. 1.

Preferably, both the base 14 and the top cap 20 are formed of molded expanded polystyrene (EPS) material. Alternatively, the base 12 and/or top cap 20 may be formed of any suitable material that can be shaped, formed or die cut to make openings for receiving the corner posts.

The corner posts are preferably formed from a sheet of wound laminated paper, such as those manufactured by Sonoco Products Company of Hartsville, S.C. and described in numerous United States and foreign patents, including Hughes U.S. Pat. No. 5,267,651, Ortlieb U.S. Pat. No. 5,593,039, Qiu U.S. Pat. No. 6,186,329, Muyskens U.S. Pat. No. 6,247,596 and Stebelton U.S. Pat. No. 6,513,662, all incorporated herein by reference. These corner posts basically are shaped paper tubes and are made from a single sheet of paper wound into a tube and shaped into the desired shape, typically one with a modified "L" shaped cross section to fit snugly about the vertical edge of the appliance. The corner posts possess significant load bearing capability.

Although in the illustrated preferred embodiment the rear corner posts 14 and front corner post 16 have different designs, it should be understood that they need not different. For example, the packaging assembly could be comprised solely of posts having locking tabs similar to the rear corner post 16 illustrated in FIG. 4 or solely of posts having a locking tab and a polygonal locking portion similar to the front post 18 illustrated in FIG. 5. Alternatively, the corner posts could comprise a single polygonal locking portion and no locking tab.

The locking features may be of any suitable configuration that interlocks with the base and/or top cap. For example, each corner post could have a single substantially L-shaped locking tab that could by itself adequately prevent lateral movement of the corner post.

Further modifications and alternative embodiments of the invention are contemplated which do not depart from the scope of the invention as defined by the foregoing teachings and appended claims. It is intended that the claims cover all such modifications that fall within their scope.

I claim:

1. A packaging assembly for holding a product, the assembly comprising:

at least one longitudinal support post, each support post having a top end and a bottom end and at least one integrally formed locking tab disposed at the bottom end; and a rectangular base having four corners and an outer perimeter and openings disposed at the corners, the openings being configured to receive the bottom ends of the support posts in interlocking fashion;

wherein the base and the support post cooperate to prevent the support post from moving laterally and wherein each support post is formed from a sheet of paper wound into a tubular structure comprising an outer wall and an inner, product-facing wall substantially coextensive with the outer wall and joined to the outer wall at outer ends to define a hollow space therebetween, and wherein each support post outer wall comprises two outer wall members joined at a right angle along an outer edge, each outer wall member extends from the outer edge to one of the outer ends, the inner wall comprises two inner wall members joined at a right angle along an inner corner, each inner wall member extends from the inner corner to one of the outer ends, and the outer and inner walls form the locking tabs at the outer ends, and wherein each locking tab is substantially planar and is formed from adjacent portions of the outer wall and the inner wall.

2. The assembly of claim 1 comprising two locking tabs and wherein the two locking tabs are oriented on non-parallel planes.

3. The packaging system of claim 2 wherein the locking tabs are spaced inwardly from the outer perimeter of the base and wherein portions of the base abut each outer wall member.

4. The assembly of claim 3 further comprising a top cap wherein the support posts extend from the base to the top cap and fit within the top cap.

5. The assembly of claim 4 further comprising transparent film wrapped around the support posts.

6. The assembly of claim 4 further comprising a transparent film placed over the product between the product and the support posts.

7. The assembly of claim 3 wherein the base is water-resistant.

8. The assembly of claim 7 wherein the base is made from expanded polystyrene.

9. A packaging assembly for holding a product, the assembly comprising:

at least one longitudinal support post, the support post having a top end and a bottom end and an integrally formed locking portion disposed at the bottom end, each support post being formed from a sheet of paper wound into a tubular structure comprising an outer wall and an inner, product-facing wall substantially coextensive with the outer wall and joined to the outer wall at outer ends to define at least one hollow space therebetween, each support post outer wall comprising two outer wall members joined at a right angle along a vertical outer edge, each outer wall member extending from the vertical outer edge to one of the outer ends, the outer and inner walls forming the locking portion at one of the outer ends; and a rectangular base having four corners and an outer perimeter and openings disposed at the corners, the openings being configured to receive the bottom ends of the support post in interlocking fashion;

wherein the base and the locking portion of the support post cooperate to prevent the support post from moving laterally, and wherein the locking portion is polygonal.

10. The assembly of claim 9 wherein the locking portion is spaced inwardly from the outer perimeter of the base and wherein portions of the base abut the outer wall.

11. The assembly of claim 10 further comprising a top cap and wherein the support posts extend from the base to the top cap and fit within the top cap.

12. The assembly of claim 11 further comprising transparent film wrapped around the support posts.

13. The assembly of claim 11 further comprising a transparent film placed over the product between the product and the support posts.

14. The assembly of claim 10 wherein the base is water-resistant.

15. The assembly of claim 14 wherein the base is made from expanded polystyrene.

16. The assembly of claim 10 wherein the outer wall comprises an inwardly directed bead having an apex in close proximity with or adjacent the inner wall, the bead dividing the corner post into a longitudinal, tubular, hollow subsection and the locking portion.

17. The assembly of claim 16 wherein the locking portion is fully enclosed.

18. The assembly of claim 16 wherein the locking portion is partially enclosed.

* * * * *